United States Patent [19]

Himmetsberger et al.

[11] 4,274,653

[45] Jun. 23, 1981

[54] SAFETY SKI BINDING

[75] Inventors: Alois Himmetsberger; Heinz Wittmann, both of Vienna, Austria

[73] Assignee: TMC Corporation, Baar, Switzerland

[21] Appl. No.: 91,447

[22] Filed: Nov. 5, 1979

Related U.S. Application Data

[62] Division of Ser. No. 896,234, Apr. 13, 1978, Pat. No. 4,190,264.

[30] Foreign Application Priority Data

Apr. 15, 1977 [AT] Austria ..... 2635/77

[51] Int. Cl.[3] ..... A63C 9/081

[52] U.S. Cl. ..... 280/618; 280/629; 280/633

[58] Field of Search ..... 280/618, 620, 619, 617, 280/616, 629, 630, 633

[56] References Cited

U.S. PATENT DOCUMENTS

| | | | |
|---|---|---|---|
| 3,145,027 | 8/1964 | Berchtold et al. | 280/629 |
| 3,647,235 | 3/1972 | Beyl | 280/618 |
| 3,966,218 | 6/1976 | Beyl | 280/618 |
| 4,113,276 | 9/1978 | Kirsch | 280/618 |

*Primary Examiner*—David M. Mitchell
*Attorney, Agent, or Firm*—Blanchard, Flynn, Thiel, Boutell & Tanis

[57] ABSTRACT

A safety release ski binding mounted in association with a sole plate construction which is pivotally secured to the upper surface of a ski for movement about a vertical axis. The locking structure for holding the sole plate construction in alignment with the longitudinal axis of the ski also effects a holding of the jaw plate and associated front jaw in a fixed position to effectively hold the ski boot in engagement with the bindings associated with the sole plate construction. The sole plate, while being pivotally secured to the ski, remains with the ski even after a release of the ski boot from engagement therewith. Upon the occurrence of a sufficient force causing the sole plate to be pivoted beyond a predefined limit, the locking structure associated with the jaw plate is released so that the front jaw is freely movable away from the ski boot to permit a release of the ski boot from engagement therewith. Thereafter, the sole plate is returned to a position axially aligned with the longitudinal axis of the ski and the front jaw returned to the position of use.

9 Claims, 18 Drawing Figures

SAFETY SKI BINDING

This is a division of application Ser. No. 896,234, filed Apr. 13, 1978, now U.S. Pat. No. 4,190,264.

FIELD OF THE INVENTION

The invention relates to a safety ski binding comprising a swivel plate which is provided at the front thereof with holding jaws arranged on a jaw plate and which can be pivoted about an axis which is perpendicular with respect to the upper surface of the ski and is held in the center position at the front end by means of a locking mechanism which is released upon exceeding a preferably adjustable torque.

BACKGROUND OF THE INVENTION

A safety ski binding of the above-mentioned type is described substantially in Austrian Pat. No. 245 488. In this known construction, the holding jaw is designed as a side jaw which is common in a ski binding which has safety tensioning means. The swivelling axis is arranged in the heel area. The jaw plate is thereby supported on the front part of the swivel plate and is constructed rotatably with respect to the swivel plate about an axis which is intersected by the longitudinal center line of said swivel plate and which is perpendicular with respect to the upper surface of the ski and the jaw plate is locked against rotation in the centered position of the swivel plate, which locking feature is terminated during swinging out of the swivel plate. The release of the ski boot through two swivable axes and additionally also a longitudinal shift of one of the locked parts is needed and is slightly complicated. The disadvantage of this construction is further that the ski boot can be removed only with difficulties from the entire ski binding after a fall, even when according to the described construction an easier release is assured.

German OS No. 25 10 385 describes further a front jaw which, after a predetermined swivel path of the ski boot, is released from a locking position and is moved away from the tip of the ski boot through the action of a spring. This does achieve an easier release of the ski boot from the ski binding parts, however, the additional cost needed for this hardly corresponds with the success achieved. Moreover, the control elements which have forcedly large dimensions in some of the embodiments which are described in this reference are not only connected with an elevated danger of wear; they are also susceptible to trouble.

The invention starts now here, which has the purpose of assuring in a ski binding of the above-mentioned type an increased assurance of release of the ski boot in a ski binding with a sole plate without resulting in the aforementioned disadvantages.

The purposes are inventively attained by the locking feature having a ski-fixed mounting plate on which rests in the closed position of the binding a slide piece of the jaw plate, which slide piece is loaded by a spring which after the release occurs returns the sole plate with the holding jaw into the closed position.

BRIEF DESCRIPTION OF THE DRAWINGS

Further advantages and details of the invention will now be discussed more in detail with reference to the drawings which illustrate some exemplary embodiments.

In the drawings:

FIGS. 1 to 3 illustrate a first exemplary embodiment, wherein FIG. 1 is a cross-sectional view taken along the line I—I of FIG. 2 and FIG. 2 is a top view of FIG. 1, partly in section, FIG. 1*a* is a detail of FIGS. 1 to 3 and FIG. 3 is a swivelled position of FIG. 2;

FIGS. 4 to 7 illustrate a second exemplary embodiment, wherein FIG. 4 is a side elevational view, partially in section, FIG. 5 is a top view of FIG. 4, partly in section, FIG. 6 is the swivelled position of FIG. 5 and FIG. 7 is a cross-sectional view taken along the line VII—VII of FIG. 4;

FIGS. 8 to 11 illustrate a further exemplary embodiment, similar to the embodiment according to FIGS. 4 to 7, wherein FIG. 8 is a top view in the closed condition of the jaw, FIG. 9 is a top view in the open condition of the jaw, FIG. 10 is a cross-sectional view taken along the line X—X in FIG. 8 and FIG. 11 is a cross-sectional view taken along the line XI—XI of FIG. 8; and FIGS. 12 to 15 illustrate a further exemplary embodiment, wherein FIG. 12 is a side elevational view in section, FIG. 13 is a top view of FIG. 12, FIG. 14 is the swivelled position of the jaw according to FIG. 13 and FIG. 15 is a detail of FIG. 13.

DETAILED DESCRIPTION

Figure 1:
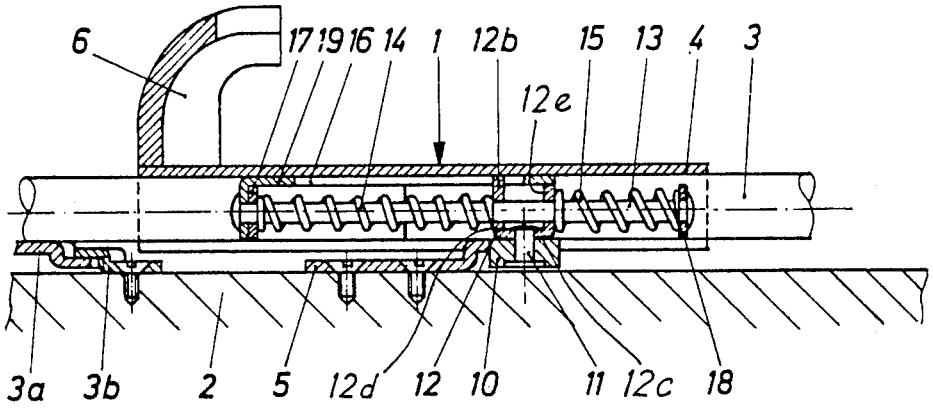

In the first exemplary embodiment, a front jaw 1 of a so-called plate binding which is not shown in further detail is illustrated. The plate binding is secured to the ski and movable between defined limits by means of an elongated linkage or pair of bars or rods 3 extending adjacent the front jaw 1 and through a jaw plate 4 mounted on a mounting plate 5 secured to the ski 2. A limited movement is permitted both transversely with respect to the longitudinal axis of the ski and also in the longitudinal direction of the ski.

The sole plate can be lifted away from the upper surface of the ski 2 to a predetermined angle prior to the occurrence of a release of the ski boot (not illustrated); however, a total separation between the sole plate and the ski 2, does not take place during a normal release operation. These details are not the subject matter of the present invention and will not, therefore, be discussed in any further detail.

Figure 3:
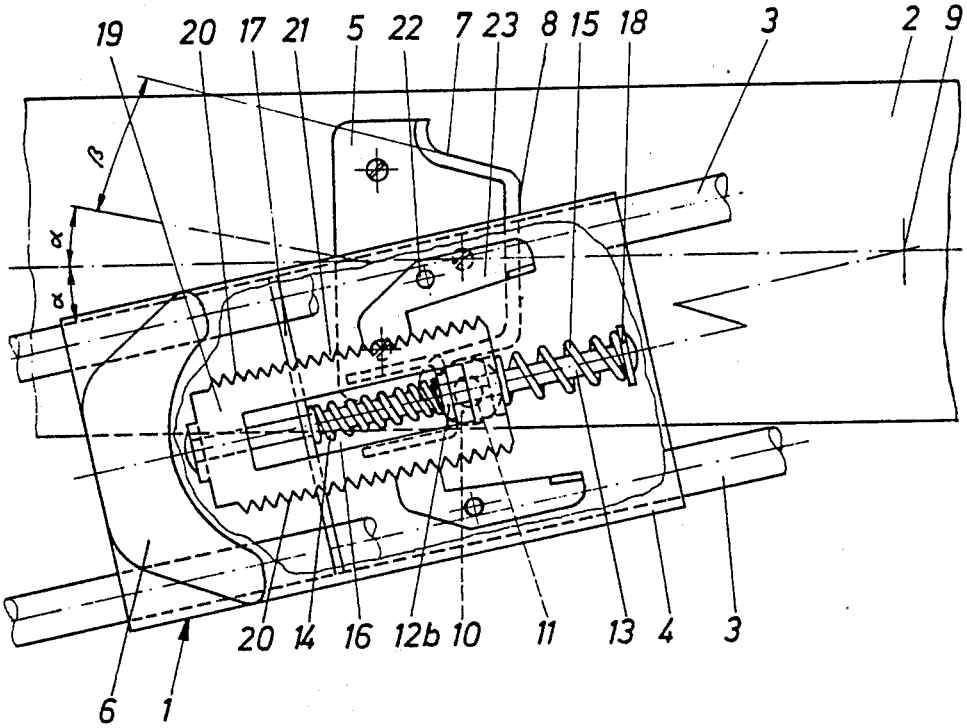

A sole holder 6 is provided on the jaw plate 4 and is fixedly connected thereto. The jaw plate 4 and the sole holder 6 may also be made of one single material. As one can best see from FIG. 3, the mounting plate 5 has along the end thereof which is remote from the sole holder 6 in the plane which extends parallel to the upper surface of the ski a pair of laterally spaced control surfaces 7, both of which extend substantially at an acute angle $\alpha+\beta$(sloped) with respect to the longitudinal axis of the ski. The control surfaces 7 are connected with one another at the common end of the mounting plate 5 through a laterally extending or bight surface 8 which also functions as a control surface. Point 9 indicates the axis of rotation of the sole plate. FIG. 3 further shows an angle $\alpha$, which indicates one half of the total angle through which the sole plate is swivelled, the lateral limits defining the location at which a release of the ski boot occurs through the already mentioned and here not discussed conventional mechanism. This angle of movement of the sole plate on one side of the longitudinal axis of the ski is in the order of magnitude of approximately 3° to 20°. The two control surfaces 7 face rearwardly away from the sole holder 6 and extend on both sides to the angles of traverse $\alpha$ and through a further angle $\beta$, for which the formula tangent $\beta \geqq \mu$ applies, wherein $\mu$ represents the coefficient of friction.

For example at a value of $\mu=0.15$, if steel slides on steel, the value $\beta=8.5°$ is obtained. Viewed in this manner, the control surfaces 7 extend in relationship to the longitudinal axis of the ski at an angle of at least 11.5°. The length of the control surfaces 7 is obtained through further construction information of the sole plate since the longitudinal space between the axis of rotation 9 and the bight surface 8 or between the axis of rotation 9 and the release mechanism, and through the path of the release mechanism from the locked position to the release of the ski boot and the width dimensions of the surfaces which participate in the release function lead automatically to a certain construction.

Figure 2:
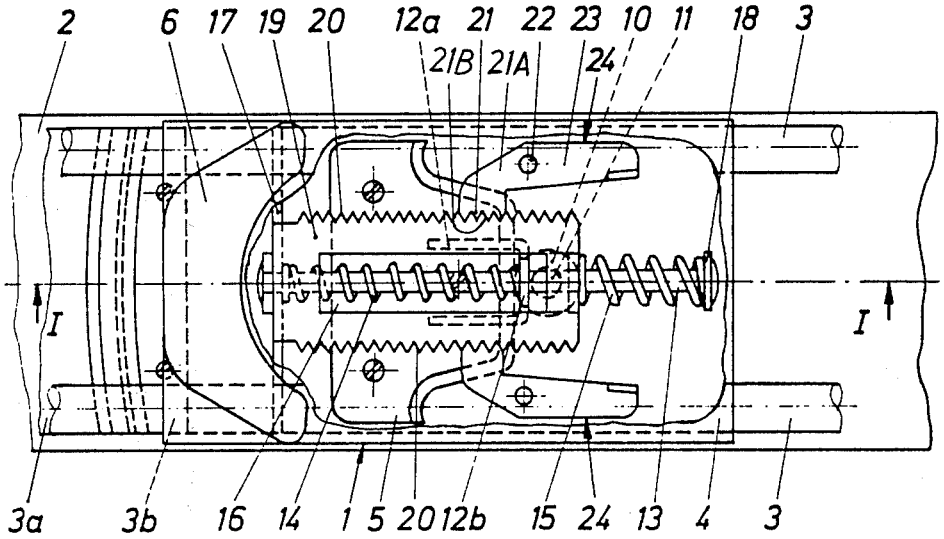

The jaw plate 4 engages the mounting plate 5 through a control or slide piece 10 and holding part 12. The slide piece 10 is secured to the holding part 12 which is in turn secured to the jaw plate 4, as will be described in more detail below. The jaw plate 4 is held in position in the locked condition of the sole plate or of the front jaw 1 by the bight surface 8 of the mounting plate 5. This is the position of use (downhill position) of the ski binding. It is illustrated in FIGS. 1 and 2. The jaw plate 4 is partly left out in FIGS. 2 and 3 in order to better show the details of the parts which are therebelow. In the present exemplary embodiment, the slide piece 10 is constructed in the form of a roller which is rotatably supported on an axle 11 positioned substantially vertically with respect to the upper surface of the ski. The slide piece 10 may, however, also be a rounded-off part, which is fixedly arranged on the holding part 12 and which has good sliding characteristics. The holding part 12 may be an angle plate, a profiled piece or the like.

To reduce the frictional forces, the control surfaces 7, the bight surface 8 and/or the slide piece 10 may consist totally or at least at the common contact surfaces of a low friction material, for example of polytetrafluoroethylene or may be covered with such a covering which is known under the name Teflon. As will better be recognized from FIG. 1*a*, the axis for the axle 11 and thus the slide piece 10 which is constructed as a roller is supported in a substantially U-shaped holding bar 12' on the holding part 12, the legs of the U extending in the vertical plane with the axle 11 being received in a hole in the bar 12', particularly in the bight portion 12*c*. A rod 13 extends through openings in the legs of the bar 12', which rod is surrounded by two springs 14, 15. The return spring 14 engages at one end—at the end adjacent the sole holder 6—a spring washer 17 encircling the rod 13 and at the other end one side of one of the leg 12*d* of the U-bar 12'. The spring washer 17 extends transversely to the longitudinal axis of the ski and is held on the two linkages 3. If the slide piece 10 and thus also the U-bar 12' are in the position of use of the sole plate according to FIGS. 1 and 2, then the spring 14 assumes only a small initially conpressed position. If a release operation is created, as same is shown in FIG. 3, then the spring 14 is compressed due to the sliding off of the slide piece 10 on one of the control surfaces 7, as this is shown in FIG. 3. Thus, the spring 14 resists any shifting tendency of the front jaw together with the ski boot on the sole plate. However, the spring 14 is relatively weak, so that a shifting of the front jaw 1 together with the ski boot is only unimportantly influenced thereby.

The spring 14 performs the function of automatically returning of the front jaw 1 following a release of the ski boot. A comparison of FIGS. 2 and 3 will facilitate a recognition that by expanding the space between the sole holder 6 and the heel holder (not illustrated) the ski boot (also not illustrated) can be freed from the binding without hindrance. When the front jaw 1 is not loaded by an outside force, the existing small force of the spring 14 is sufficient to urge the front jaw again into the initial position. The spring 14 urges through the holding part 12 the slide piece 10 away from the control surface to an arcuately spaced but nevertheless aligned relationship with the central bight surface 8. In this position, the front jaw is returned to the ready to use position and the release mechanism which is arranged in the heel area moves the sole plate and thus the front jaw 1 into the initial position which is shown in FIGS. 1 and 2. In this initial position, the slide piece 10 engages the central bight surface 8. The binding is therewith again ready for use.

The spring 15 is a thrust spring for the entire binding. Its initial compression can be adjusted in a conventional manner to the characteristics of the skier by the man skilled in the art. These details will not be discussed in detail. The thrust spring 15 has no actual influence on the release operation; it only contributes at the start of the release operation to the movement of the front jaw 1 by imparting an impulse to the slide piece 10 at the start of the movement of the slide piece 10 along one of the control surfaces 7 and thus cancels the friction forces which acts against the movement of the front jaw 1. After imparting this impulse, the thrust spring 15 does not partake in the further release operation. The thrust spring 15 is clamped between a spring washer 18 mounted on the end of the rod 13 remote from the spring washer 17 and the other leg 12*e* of the U-bar 12'.

In order to be able to adjust the ski binding to different length ski boots, a guideway 16 is provided in a guide part 19, which guide part has teeth 20 on its two lateral sides. Swivel arms 21A having locking teeth 21B thereon are pivotally mounted on the jaw plate 4 on swivelling axes 22 for movement into and out of engagement with the teeth 20. Even if the shown symmetric arrangement is more advantageous, the same effect can also be achieved by providing teeth on only one side of the guide part 19 and by providing only one swivel arm having locking teeth cooperating with the teeth on the guide part. To adjust to or to fit for a new ski boot size, the swivel arms 23 are moved toward each other in direction of the two arrows 24 (FIG. 2) against a spring force from not illustrated springs so that the engagement between the locking teeth 21B and the teeth 20 is cancelled and the front jaw 1 can be moved into the desired (new) position. After the adjustment procedure has been completed, the swivel arms 23 are released and the engagement between the locking teeth 21B and the teeth 20 is again created and the ski binding is ready for the (new) ski boot to step into the bindings.

The U-bar 12' is connected to the front jaw 1 through the rod 13, through the guide part 19 secured to the rod 13 adjacent the spring washer 17 at one end and to the holding part 12 at the other end and through the swivel arms 23 mounted on the jaw plate 4. Two arms 12*a* of the holding part 12, which is designed as a U-bar, which arms extend on both sides of the guide part 19 and which are supported on the upper side of the mounting, prevent a tipping of the U-bar and thus a lifting off of the slide piece from the control surfaces 7 or from the bight surface 8.

Figure 1A:
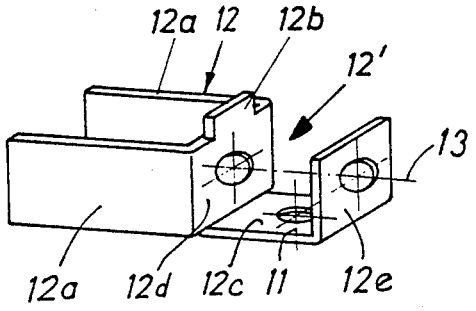
Figure 4:
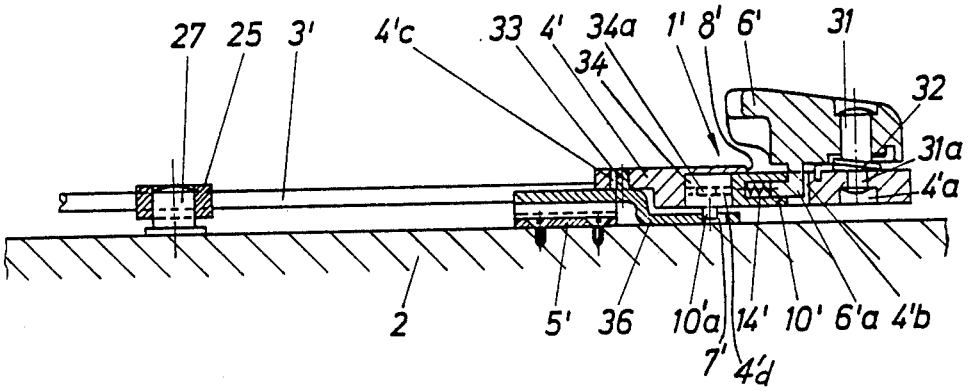
Figure 7:
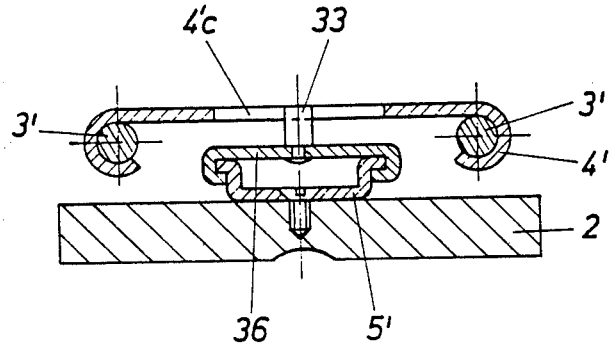
Figure 10:
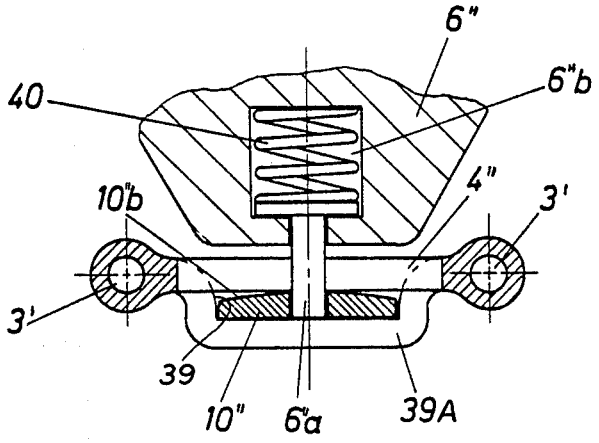
Figure 11:
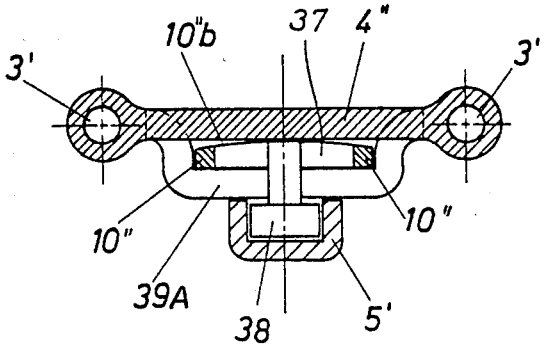
Figure 4A:
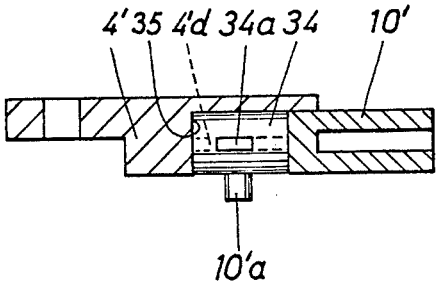
FIG. 4*a* is an enlarged fragment of the structure illustrated in FIG. 4.
Figure 12:
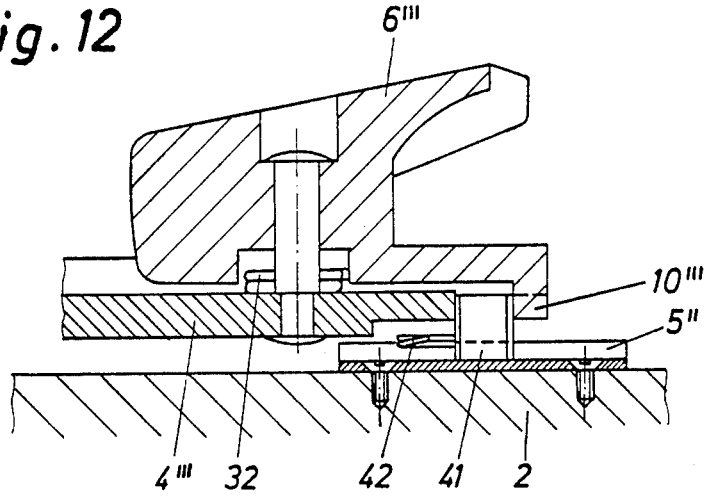
Figure 15:
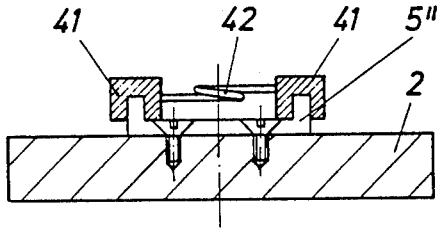
Figure 4B:
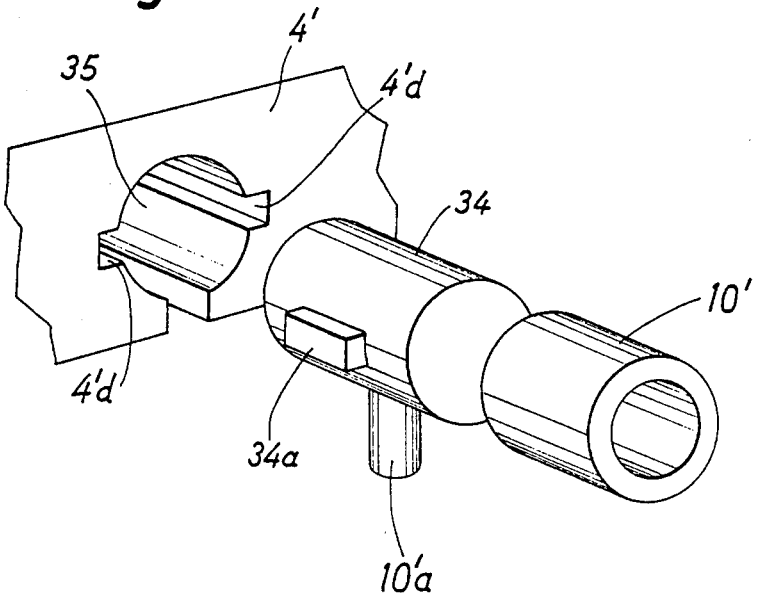
FIG. 4*b* is an exploded fragment of the structure illustrated in FIG. 4*a*.

As can further be recognized from FIG. 1*a*, the U-bar 12' has on its front side an upwardly extending projection 12*b*, which is stepped toward the longitudinal axis of the ski. The projection 12*b* is received in the guideway 16 of the guide part 19 and transmits the lateral swing of the sole plate (of the linkages 3) onto the holding part 12 and thus effects an unlocking of the slide piece 10 from the bight surface 8.

A comparison of FIGS. 2 and 3 shows the change of the position of the individual parts in the position of use and in the swivelled position of the sole plate.

As mentioned already above, the here shown linkage pair or pair of rods 3 can be replaced with a unitized sole plate. Only a few construction changes must then be made in order to achieve the described effect. In choosing a correspondingly large angular adjustment ($\alpha+\beta$), the use of the spring 14 (return spring) is not needed, because the mechanism which exists adjacent the heel binding can alone assure the return thereof (see U.S. Pat. No. 4,033,603).

The connection between the guide part 19 and the jaw plate 14 can be constructed also in a different manner, for example, through a longitudinally adjustable bar, through a slide member or similar ways.

The linkage pair or pair of rods 3 is pivotally supported on the ski, however, is not vertically removable from the ski 2 by the provision of a bent holding part 3*a* secured to the linkage pair 3 and by a further ski-fixed mounting plate 3*b* (compare FIGS. 1 and 2).

SECOND EMBODIMENT (FIGS. 4 to 7)

Figure 5:
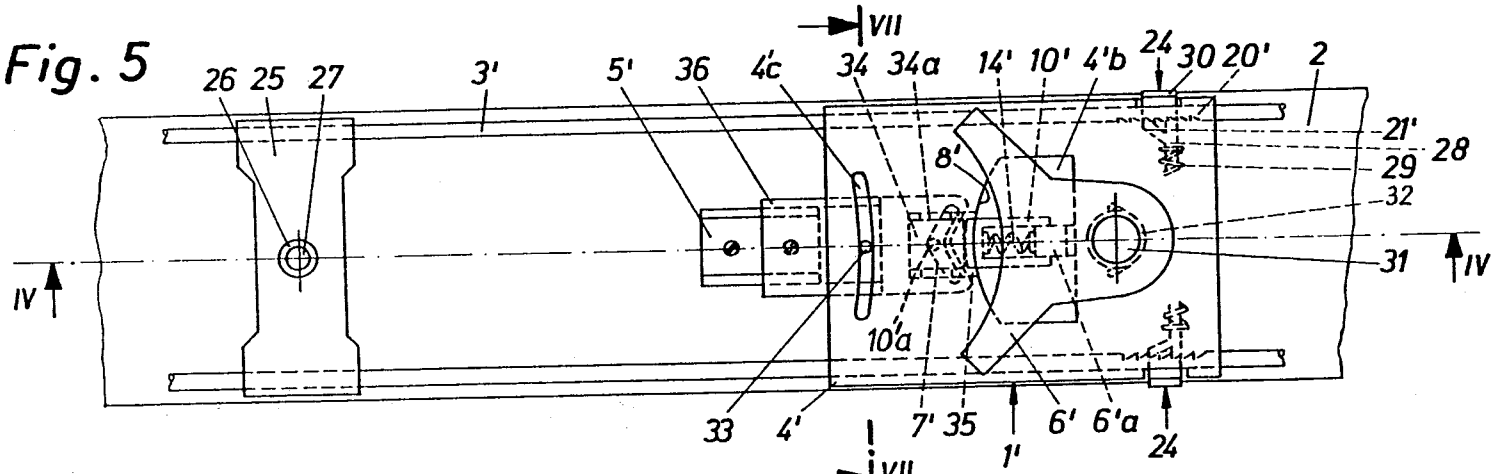

The embodiment according to FIGS. 4 to 7 illustrates a front jaw 1' in association with a jaw plate 4', which is movable with respect to a ski-fixed mounting plate 5'. The mounting plate 5' is connected to the jaw plate 4' through a control member 36. A plate 25 bridging the pair of rods 3' has an opening 26 therein for receiving a ski-fixed pin 27 therein, which pin 27 defines the axis of rotation which was schematically illustrated by the point 9 in the first exemplary embodiment. To effect a longitudinal adjustment of the jaw plate 4', teeth 20' are provided at least on one, in the present exemplary embodiment, on both rods 3'. The teeth 20' are engaged by locking teeth 21' of a locking means 28 which is spring biased by a spring 29. To cancel this locking engagement, two trigger devices 30 are provided and which must be pressed to one another in direction of the two arrows 24 (FIG. 5). This releases the jaw plate 4' and renders it movable in longitudinal direction of the ski and adjustable to the desired length of the boot. After the trigger 30 is released, namely, the force at 24 removed, the locking teeth 21' again engage the teeth 20' and the sole plate is ready to receive the boot in the bindings. This adjustment feature is actually known and is not the subject matter of the present invention.

Figure 6:
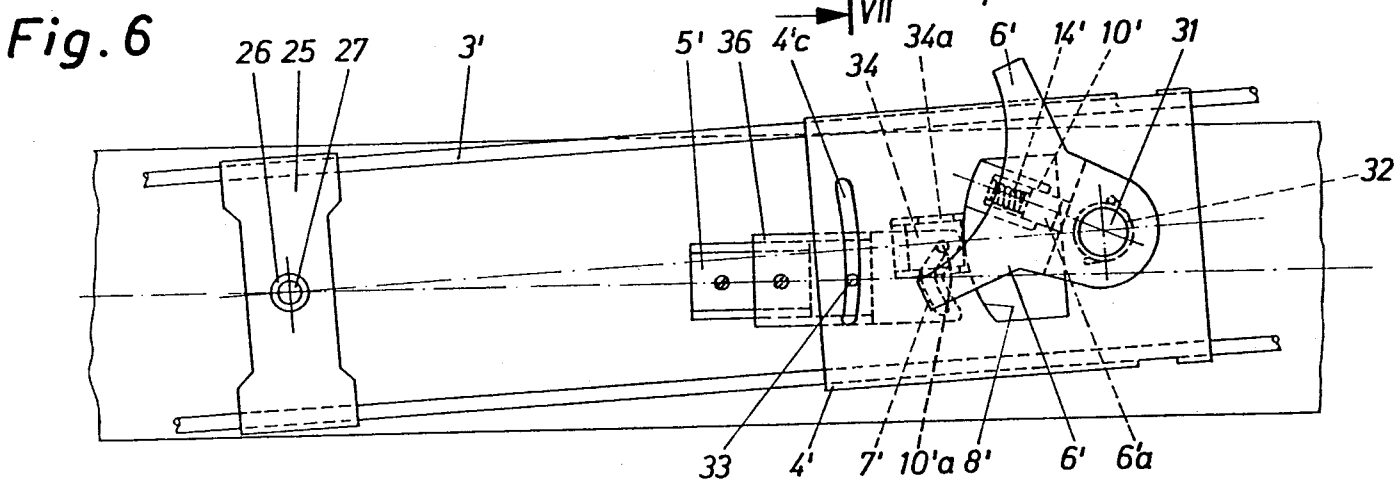

In the present exemplary embodiment, the sole holder 6' is pivotally supported about an axis of rotation 31 which extends vertically with respect to the upper surface of the ski and against the force of a relatively weak torsion spring. The sole holder 6' generally has a Y shape as viewed from the top and the sole of the ski boot is held down by the two legs of the Y. The axis of rotation 31 is arranged in the stem or base leg of the Y. The axle member defining the axis of rotation 31 of the sole holder 6' is anchored in the jaw plate 4'. The jaw plate 4' has for this purpose a recess 4'*a* in the under surface thereof and the lower end of the axle 31 is riveted at its lower end in the recess. The lower end of the axle 31 is transformed into a shoulder 31*a*; the material thickness of the jaw plate 4' forms in this manner a kind of a fix bearing for the axle 31. Furthermore, the jaw plate 4' has a further recess 4'*b*, through which extends an extension 6'*a* of the sole holder 6'. The recess 4'*b* is constructed in the form of a squarelike opening (see FIG. 5) with the difference that one side of the hollow space is arched and forms a control surface 8' for a slide piece 10' which is spring biased by a spring 14'. The slide piece 10' is constructed in the form of a hollow cylindrical member and is positioned on the front free end zone of the extension 6'*a* of the sole holder 6' and biased by an interpositioned spring 14' mounted between the extension 6'*a* and the slide piece 10'. The slide piece 10' and the extension 6'*a* are in constant telescoping relation; however, the degree of the telescoping overlap depends on the closed or open position of the sole holder. The amount of overlap is less in the first case and the spring 14' is less tensioned, in the second case the overlapping between the extension 6'*a* and slide piece 10' is greater and the spring 14' is compressed. FIGS. 5 and 6 are pointed out.

The jaw plate 4' has an arcuate recess 4'*c* therein into which projects a guide bolt 33 of a control member 36. The control member 36 has on its (front) area which faces the sole holder 6' control surfaces 7' which are struck out on both sides of the longitudinal center line and form an approximately V-shaped opening as viewed from the top. When the sole plate is swivelled, a further slide piece 10'*a* slides on the associated surface, depending on whether the sole plate is swung to the left or to the right. The further slide piece 10'*a* is constructed as a pin mounted on an intermediate piece 34 in the present exemplary embodiment. In the closed position of the ski binding, the intermediate piece 34 is in alignment with the slide piece 10', which in this position extends in a recess 35 which is constructed adjacent the recess 4'*b* and which opens into the recess 4'*b* to facilitate a limited lateral movement of the slide piece 10' therein. By swivelling the sole plate beyond the limits of the recess 35, the slide piece 10' is moved frontwardly caused by a moving of the intermediate piece 34 and the further slide piece 10'*a* along the surface 7' until the engagement between the recess 35 and the slide piece 10' is terminated. The intermediate piece 34 is guided by flanges 34*a* received in lateral recesses 4'*d* of the jaw plate 4' communicating with the recess 35. Following a termination of the engagement, the sole holder 6' is swung only against the resistance of the weak torsion spring 32 and the ski boot is released. Subsequently the torsion spring 32 swings the sole holder 6' back into the closed position. The ski binding is again ready for use.

THIRD EMBODIMENT (FIGS. 8 to 11)

Figure 8:
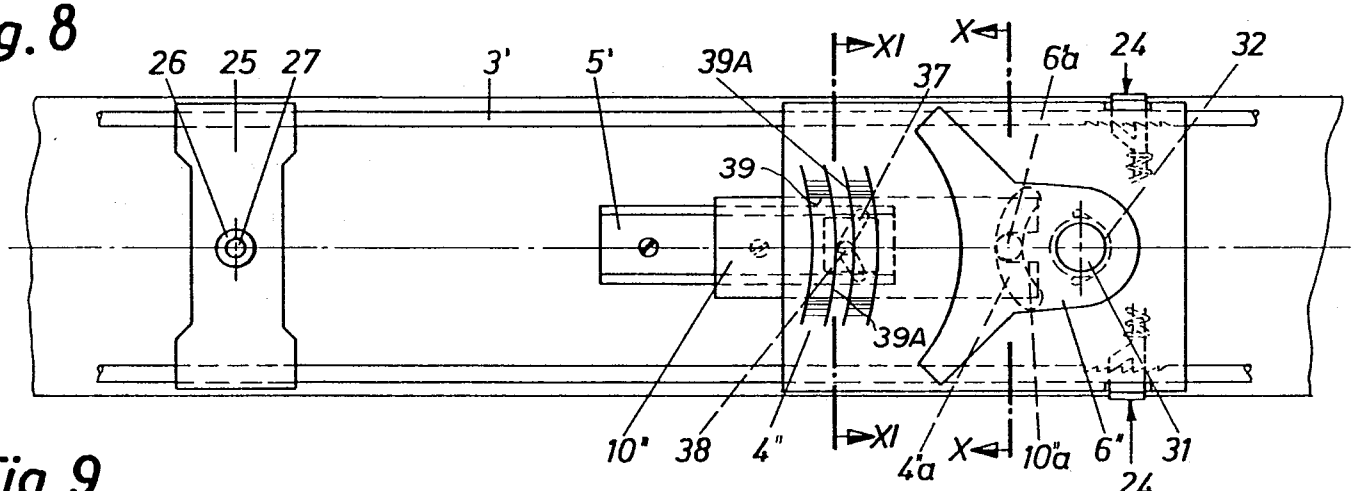
Figure 9:
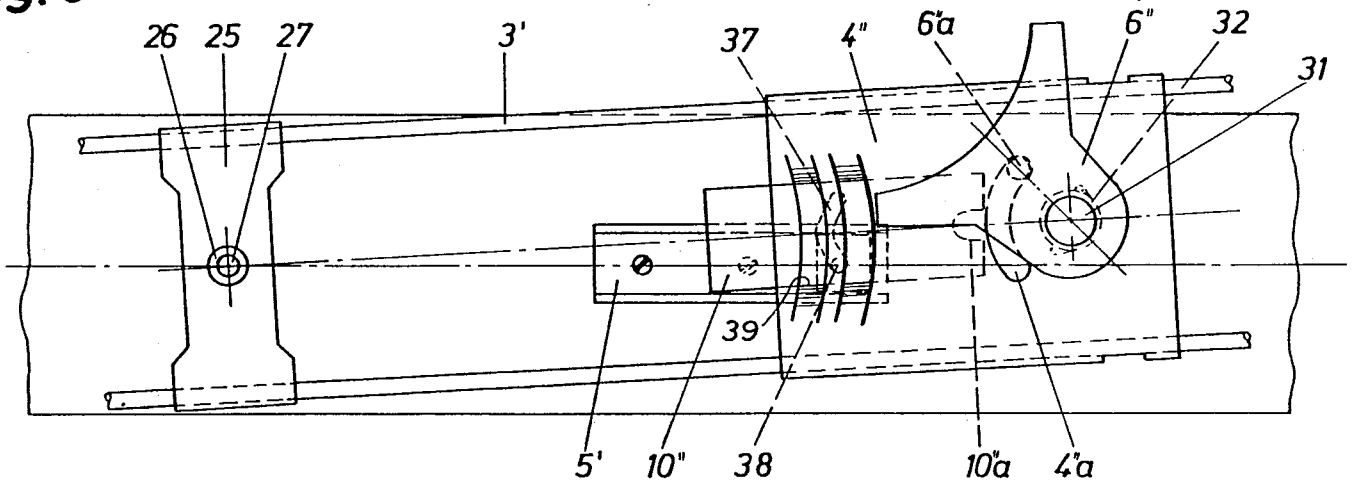
Figure 13:
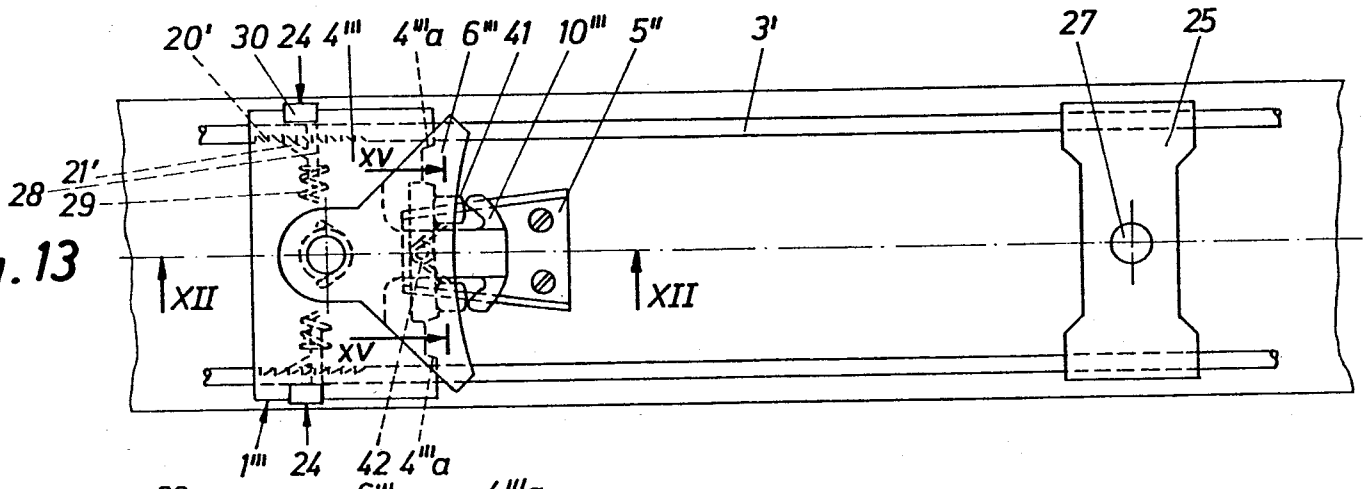

The next exemplary embodiment according to FIGS. 8 to 11 illustrates a modification for the aforediscussed exemplary embodiment. For this reason only those parts are discussed which are different from the already described embodiments. According to FIGS. 8 and 9, a slide piece 10'' is longitudinally slidably mounted on a track 39 on the jaw plate 4'', which slide piece has a recess 37 therein into which extends a guide bolt 38 which is longitudinally movable guided in the U profile of the mounting plate 5'. The guide bolt 38 is received between and engages a pair of parallel guideway surfaces 39A of a slot 39 on the jaw plate 4''. The jaw plate 4'' can be adjusted in the already described manner along the pair of rods 3'; the guide bolt 38 following, due to its engagement with the guide surfaces 39A, the adjustment of the jaw plate 4'' in association with the slide piece 10''. The slide piece 10'' has furthermore on its side adjacent the sole holder 6'', a recess 10''*a* therein receiving a downwardly projecting extension 6''*a* of the sole holder 6'' therein and which is disengagable therefrom. FIG. 8 illustrates the closed position, in which the extension 6''*a* is positioned in the recess 10''*a*. The extension 6''*a* is guided in a curved recess 4''*a* of the jaw plate 4''. According to FIG. 10, it will further be recognized that the extension 6''*a* of the sole holder 6'' is constructed as a bolt which is spring biased by a spring 40, furthermore that the slide piece 10'' has sloped surfaces 10''*b* on both sides of the longitudinal center line. This embodiment facilitates a safe return of the sole holder 6'' after carrying out the release operation or prevents snagging or any hanging up between the extension 6''*a* and the slide piece 10'' due to the return. The sole holder 6''*a* is returned by means of an already described torsion spring 32. The spring 40 is arranged in a recess 6''*b* of the sole holder 6''. A comparison of the now described embodiment with the preceding embodiment according to FIGS. 5 to 7 will facilitate a recognition that the elasticity or flexibility, namely, the range within which a release of the ski boot does not yet occur, is achieved by utilizing two parts. A release occurs only when the locking engagement between the recess 10''*a* and the extension 6''*a* is terminated. On the other hand, the start of the release operation depends on the construction of the curvature of the recess 37 or all together from the construction of this recess. Depending on the existing construction conditions, the recess 37 can be designed as a cam plate. It may, however, also have a bight surface similar to the first embodiment wherein on both sides thereof control surfaces are provided. This latter construction is particularly advantageous if one wants to keep the degree of engagement between the extension 6''*a* and the recess 10''*a* of the slide piece 10'' as small as possible. This latter type of construction is considered as more advantageous for a satisfactory operation than is a construction in which the elasticity or flexibility range is more left up to the locking engagement relationship between the sole holder and the slide piece. In spite of this, the present exemplary embodiment is illustrated because it is more advantageous for purposes of illustration. Of course, it is possible to combine the two solutions with one another and to permit the elasticity to act partly through a surface in the recess 37 and partly through the length of the recess 10''*a*.

Further details correspond to what has already been described.

FOURTH EMBODIMENT (FIGS. 12 to 15)

In a still further embodiment according to FIGS. 12 to 15, the slide piece 10''' is mounted directly to and being integral with the sole holder 6'''. The slide piece 10''' extends downwardly from the bottom thereof, namely, in the form of a projection. The slide piece 10''' is supported on sliding members 41, which in turn are mounted on a ski-fixed mounting plate 5'' and are connected with one another by means of a spring 42. The mounting plate 5'' is constructed in the form of a forwardly converging rail pair. The length of the mounting plate 5'' and the convergency of the rail pair is thereby chosen such that the release operation or the angle of traverse which is needed for this remains constant in every position of the longitudinally adjustable jaw plate 4'''. The construction of the pair of rods 3' and the length adjustment mechanism for the jaw plate 4''' on the pair of rods 3' corresponds to that which has already been described.

Figure 14:
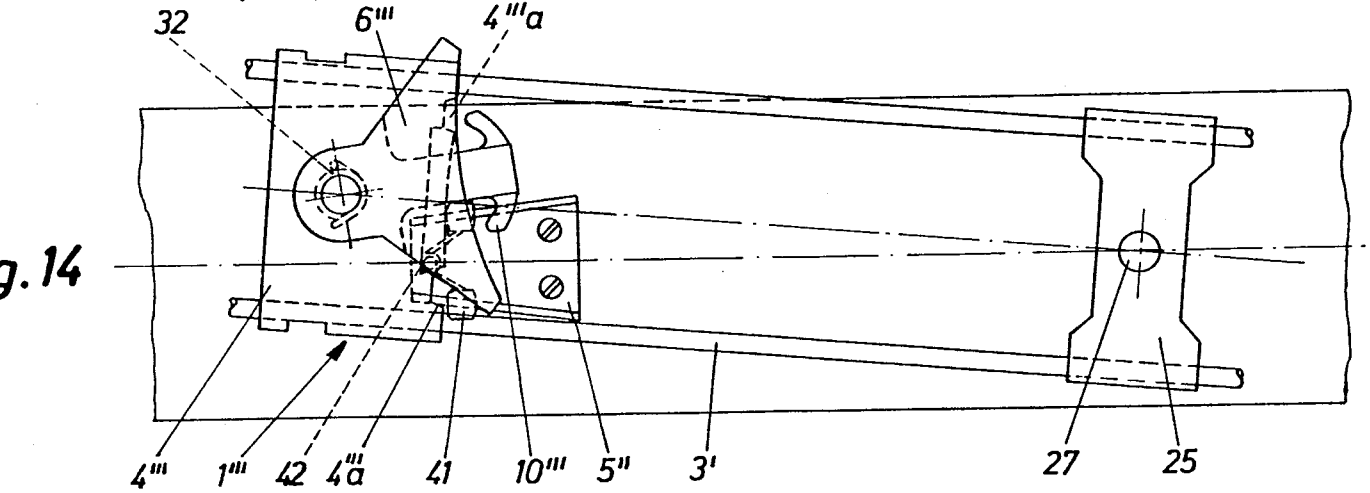

The jaw plate 4''' has adjacent the mounting plate 5'', on both sides of the longitudinal center line symmetrically arranged recesses 4'''*a* which receive the free ends of the slide piece 10''' portions (of the two projections) in connection with a release operation, as this can be taken indicatively from FIG. 14. As a result, it is possible to change the width and/or length of the two projections 10''' between larger ranges, which circumstance facilitates a better adjustment of the entire front jaw 1''' to the construction conditions which must be met. From FIGS. 13 and 14, it can also be recognized that the areas of the sliding members 41, which areas face the slide piece 10''', are embossed. As a result, a better sliding of the two projection parts of the slide piece 10''' on the sliding members 41 is achieved. It is also possible to proceed in such a manner that the sliding members 41 are constructed with sloped surfaces which extend in direction of the longitudinal axis of the ski and forwardly or have partly a sloped surface with rounded portions and partial embossing.

The release operation corresponds substantially with the aaforedescribed embodiments with the difference that here the projection portions slide on the slide members 41. After they have left same, the sole holder 6''' is moved due to the action of the external forces and causes the ski boot to be released. After the ski boot has been released, the sole holder 6''' is moved again into the initial position, namely, the locked position according to FIG. 13, through the action of the torsion spring 32.

The invention is not limited to the discussed exemplary embodiments. A number of modifications are possible without departing from the scope of the invention. For example, it would be possible to use the slide piece according to the second exemplary embodiment also in an arrangement according to the third or fourth exemplary embodiment, assuming that corresponding guide parts and longitudinally movably arranged parts which are in alignment with one another would cooperate with one another. It can also easily be understood that wherever sliding or guiding pins or bolts cooperate with control surfaces, these can be replaced with rollers or can be equipped with rollers. It has already been pointed out that the control surfaces and/or the parts which slide thereon can be made of a low friction material or can have a layer of such a material. The longitudinal adjustment feature itself is not the subject matter of the present invention. Of course, it is possible to use also differently designed adjusting devices in combination with the subject matter of the application.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A safety ski binding comprising a pivotally supported sole plate provided adjacent a front end thereof with a jaw plate having a holding jaw pivotally supported for movement about an axis which is perpendicular with respect to an upper surface of a ski, said sole plate being maintained in a centered position at said front end by means of a locking mechanism which is released upon exceeding a predetermined torque, the improvement comprising wherein said locking mechanism has a mounting plate secured to said ski, said jaw plate having means defining a recess therein, the axis of said recess extending parallel to the longitudinal axis of said sole plate, slide piece means slidably mounted in said recess for reciprocal movement therein, said slide piece means having first connecting means thereon, said holding jaw having extension means thereon with second connecting means operatively connected to said first connecting means for reciprocal movement capability with said slide piece means, said first and second connecting means operatively effecting a locking of said holding jaw in a fixed position on said jaw plate by urging said slide piece means to a position within said recess, and means responsive to a pivotal movement of said sole plate for effecting a movement of said slide piece means out of said recess to thereby unlock said holding jaw from said jaw plate to permit a pivotal movement of said holding jaw on said jaw plate.

2. The safety ski binding according to claim 1, wherein said holding jaw has a centering spring for continually urging said holding jaw to a centered position on said jaw plate.

3. The safety ski binding according to claim 2, wherein said centering spring is a torsion spring wound around the pivot axis for said holding jaw.

4. The safety ski binding according to claim 1, wherein said jaw plate includes an opening adjacent said means, laterally opposite sides of said opening including first control surfaces which are arcuate and have a center coincident with the pivot axis for said holding jaw;

wherein said slide piece means has an arced contact surface to facilitate a sliding of said contact surface on said first control surface when said slide piece means is positioned outside of said recess and said holding jaw is pivoted about the pivotal support therefor.

5. The safety ski binding according to claim 1, wherein said slide piece means includes a first slide piece and a second slide piece, said means responsive to a pivotal movement of said sole plate includes means defining a control surface on said mounting plate and a pin on said first slide piece slidingly engaging said control surface, said control surface having a contour for effecting a movement of said first slide piece toward the outer end of said recess upon pivotal movement of said sole plate; and wherein said second slide piece is telescopingly connected to said extension means by said first and second connecting means and in end-to-end contact with said first slide piece, a movement of said first slide piece toward said outer end of said recess effecting a telescoping of said second slide piece and said extension means until said second slide piece is out of said recess to thereby unlock said holding jaw from said jaw plate.

6. The safety ski binding according to claim 5, including a spring connected to and extending between said second slide piece and said extension means for continually urging said second slide piece toward said first slide piece.

7. The safety ski binding according to claim 5, wherein said second control surface is defined by an upwardly opening V-shaped slot in said mounting plate into which said pin is received.

8. The safety ski binding according to claim 5, wherein said jaw plate includes an opening adjacent said recess, laterally opposite sides of the opening including second control surfaces which are arcuate and have a center coincident with the pivot axis for said holding jaw;

wherein said second slide piece has an arced contact surface to facilitate a sliding of said contact surface on said second control surface when said slide piece is positioned outside of said recess and said holding jaw is pivoted about the pivotal support therefor.

9. The safety ski binding according to claim 5, wherein said first slide piece has support flanges thereon received in grooves in said recess.

* * * * *